United States Patent [19]

McKown

[11] Patent Number: 4,930,700

[45] Date of Patent: Jun. 5, 1990

[54] ULTRASONIC DISPERSION NOZZLE HAVING INTERNAL SHUT-OFF MECHANISM WITH BARRIER FLUID SEPARATION

[75] Inventor: Clem S. McKown, Lake Hapatacong, N.J.

[73] Assignee: Atochem North America, Woodbridge, N.J.

[21] Appl. No.: 260,096

[22] Filed: Oct. 19, 1988

Related U.S. Application Data

[63] Continuation-in-part of Ser. No. 900,931, Aug. 27, 1986, abandoned.

[51] Int. Cl.[5] ..... B05B 3/14

[52] U.S. Cl. ..... 239/102.2; 239/300; 239/569

[58] Field of Search ..... 239/102.2, 300, 4, 569; 310/323

[56] References Cited

U.S. PATENT DOCUMENTS

| | | | |
|---|---|---|---|
| 1,939,302 | 12/1933 | Heaney | 239/102.1 X |
| 2,481,620 | 9/1949 | Rosenthal | 239/102.2 |
| 2,715,046 | 8/1955 | Ackerman | 239/300 |
| 3,711,020 | 1/1973 | Zelna | 239/4 X |
| 3,970,250 | 7/1976 | Drews | 239/102.2 |

FOREIGN PATENT DOCUMENTS 69222 4/1945 Norway .

*Primary Examiner*—Andres Kashnikow
*Assistant Examiner*—Kevin P. Weldon
*Attorney, Agent, or Firm*—S. A. Marcus; R. B. Henn; R. G. Ort

[57] ABSTRACT

An ultrasonic nozzle includes an atomizing surface for producing an atomized liquid spray; a liquid-feed passageway for supplying the process liquid to the atomizing surface, the passageway having a first diameter section and a second fluidly connected smaller diameter section, with a shoulder defined therebetween; an internal shut-off assembly for preventing the supply of process liquid to the atomizing surface, the shut-off assembly including a shut-off rod slidably positioned within the passageway and having a sealing end adapted to cooperate with the shoulder to prevent the supply of process liquid to the atomizing surface, an actuator piston connected with the opposite end of the shut-off rod and slidable within a cylinder bore that is in fluid communication with the passageway, and a valve actuator for slidably moving the piston and shut-off rod in the passageway between a first closed position in which the supply of liquid to the atomizing surface is prevented and a second open position in which the supply of liquid to the atomizing surface is permitted; a barrier fluid provided in the cylinder bore between the passageway and the piston at a pressure higher than that of the process fluid in the passageway to prevent the process fluid from adversely affecting the shut-off assembly; and a substantially frusto-conical air guide in concentric surrounding relation to the atomizing surface at the tip of the nozzle to direct and diffuse the spray formed at the atomizing surface.

9 Claims, 5 Drawing Sheets

ULTRASONIC DISPERSION NOZZLE HAVING INTERNAL SHUT-OFF MECHANISM WITH BARRIER FLUID SEPARATION

REFERENCE TO RELATED APPLICATION

This application is a Continuation-In-Part of copending U.S. patent application Ser. No. 06/900,931, filed Aug. 27, 1986 and now abandoned, entitled Internal Shut-Off Assembly for Ultrasonic Dispersion Nozzle, by Clem S. McKown, and having a common assignee herewith.

BACKGROUND OF THE INVENTION

The present invention relates generally to ultrasonic dispersion nozzles and, more particularly, is directed to an ultrasonic dispersion nozzle having a novel shut-off assembly.

Conventionally, spraying processes have used nozzles that rely on pressure and high velocity fluid motion to atomize liquids. Generally, such nozzles are hydraulic (pressure) operated devices in which pressurized liquid is forced through the orifice and liquid is sheared into droplets, or are of the two fluid air atomizing type in which high pressure air or gas mixes with liquid in the nozzle and the air imparts a velocity to the liquid, which is then ejected through an orifice. These nozzles are available in a wide variety of designs with numerous spray shape patterns and flow rate capacities. Examples of the latter type of nozzles are those sold by Spraying Systems Co., North Avenue at Schmale Road, Wheaton, Ill. 60187 under the 1/4JAU Series.

However, such nozzles have various shortcomings that can cause operational and reliability problems. For examples, although a high velocity spray may be appropriate for some applications, it is undesirable in others because the droplets hit the surface to be coated with so high a velocity that some of the coating material bounces off. This overspray condition is not only wasteful, but in addition, this also results in the spray being dispersed into the environment, which can be hazardous.

Another persistent problem with such nozzles is clogging. Specifically, in order to achieve the high velocities required to break up the liquid, small diameter channels and outlet orifices are needed. Because of these small diameters, however, the passageways are prone to blockage. This occurs when the fluid material dries in the orifices after the nozzle is shut off, when suspended particles gradually deposit in the nozzle, and/or when foreign matter enters the fluid stream. In order to remedy the latter two causes a high-quality filtration equipment is necessary. In order to remedy the first cause, the nozzle must be flushed after each use. It will be appreciated that a completely blocked passageway results in total nozzle failure, while a partially blocked orifice or channel can cause a distorted spray pattern or produce coarse droplets or decreased flow rates.

Distortion in the spray pattern can also occur when passageways are eroded by abrasive particles suspended in the liquid. Because of the high pressure and velocities that are used, even the hardest nozzle materials are damages within a relatively short period of time.

In view of these problems, various applications require the use of ultrasonic nozzles which avoid the aforementioned problems. Examples of such ultrasonic nozzles are those sold by Sono-Tek Corporation, 313 Main Mall, Poughkeepsie, N.Y. 12601. Reference is also made to U.S. Pat. Nos. 4,153,201, 4,301,968; 4,337,896; and 4,352,459, all having Sono-Tek Corporation as the common assignee. With these nozzles, atomization is achieved by vibrating a metallic surface at frequencies in the ultrasonic range, that is, above 20 kHz. Specifically, liquid is delivered to the atomizing surface through an axial feed tube running the length of the nozzle, and for obtaining the necessary vibration, the nozzle incorporates plezoelectric transducers sandwiched between nozzle halves, whereby the vibrational motion is transmitted, amplified and concentrated at the atomizing surface.

As a result of such vibrations, there is a formation of a two-dimensional grid of capillary waves in a surface film, that is, in the liquid film on the atomizing surface of the nozzle. As the amplitude of the underlying vibration increases, the height of the surface wavelets also increases until a critical amplitude is reached. At such time, the wave peaks become unstable and separate from the bulk liquid, whereby the liquid dispersed from the nozzle's atomizing surface takes the form of drops smaller than or equal to the size of the wave crests on which they were formed. Since wavelength is inversely related to frequency, higher vibrational frequencies result in smaller droplets.

With such nozzles, since the atomization process is not pressurized, the diameter of the bore of the axial feed tube is unrestricted. Therefore, liquid emerges onto the atomizing surface at a low velocity and spreads out into a thin film, and is atomized as described above.

The ultrasonic nozzles therefore provide distinct advantages over conventional nozzle arrangements. Specifically, the unpressurized operation results in a softer spray, with spray velocities being less than those typically produced by conventional nozzles by at least a factor of ten. Thus, the bouncing off of the spray material from the surface to be coated is substantially avoided, along with the aforementioned overspray condition. As a result, there is a resultant saving of expensive materials. Further, because unpressurized liquid is used, ultrasonic nozzles consume a minimum amount of power, for example, as little as four watts of electricity. Still further, because a large liquid-feed tube is used, for example, up to ⅜ inch, there is effectively a clog-free operation, even at supply rates of 0.1 g/hr. Other advantages include a large turn-down ratio, the capability of producing tiny droplets with median diameters as low as 20 microns, and the ability to entrain the spray in a moving gas stream to accurately define a desired spray pattern and provide uniform coverage of large surface areas.

During intermittent processes, it is often important that there be a sharp cessation of fluid flow when the coating operation is terminated. In the aforementioned two-fluid supply nozzles sold by Spraying Systems Co., an internal shut-off assembly is provided which functions to interrupt the liquid portion of the spray only. Specifically, a stainless steel shut-off needle is provided in the liquid-feed tube. An air operated cylinder is provided to retract the shut-off needle against the force of the coil spring in order to start spraying. Since such nozzles operate under a high pressure and velocity, the shut-off needle does not effectively interfere with the supply of liquid. In such nozzles, since only the liquid-feed tube is closed, there is still an output from the high velocity atomizing air tube unless separate provisions are made to terminate this stream.

It had previously been believed that an internal shut-off assembly could not be provided with an ultrasonic nozzle, possibly because it was believed that there would be interference between the shut-off needle and the wave peaks that are formed. Instead, in order to discontinue liquid feed to an ultrasonic nozzle, particularly during intermittent operations, Sono-Tek Corporation recommends that an automatic solenoid valve be installed in the liquid-feed line upstream of the nozzle, and that the power supply for the piezoelectric transducers be equipped with an interlock that attenuates the vibrations when the nozzle is off.

However, in actual tests with methanol and with an organotin-based coating formula containing butyltin trichloride, in which an interlock activated by a process timer was provided such that vibrations of the piezoelectric transducers were attenuated and wotj a two-way electric solenoid valve installed immediately upstream of the ultrasonic nozzle, it was found that liquid dripped from the nozzle's orifice outlet following discontinuation of the liquid feed. When the interlock was by-passed, liquid atomization continued from the nozzle tip for several seconds following discontinuation of the liquid feed. Such tests were performed with a ultrasonic nozzle mounted in a horizontal orientation and with a liquid-feed duration of approximately 0.5 seconds, which are typical for commercial fluorescent bulb coating processes.

Failure to achieve a sharp cessation of liquid flow from the nozzle's orifice in such applications is believed to be a result of the low surface tension of the liquids tested. As a class, liquid coating formulations to be applied to hot glass surfaces for the pylolytic formation of an $SNO_2$ film thereon tend to have relatively low surface tensions.

It has recently been suggested, however, that an internal shut-off assembly could be provided with an ultrasonic nozzle. Specifically, in European Patent Application No. 81101985.0, published on Sept. 30, 1981 under Publication No. 0036617, there is described a fuel injection nozzle, the injection end of which is constructed as an ultrasound fluid atomizer having a working plate and truncated cone-shaped bending oscillator with piezoelectric motive power. The atomizer has a central bore having two different diameters so as to define a narrowing shoulder or seat, and a nozzle pin or rod is slidably provided in the bore of the atomizer and has a frusto-conical end that seats on the shoulder so as to cut off the supply of liquid to the atomizing surface.

The aforementioned copending U.S. patent application Ser. No. 06/900,931, the entire disclosure of which is incorporated herein by reference, describes a similar system. In such system, a 0.040 inch diameter tungsten shut-off needle is used, the free end of which is shaped to form a sealing tip near the spray orifice of the nozzle. A reduction in the bore diameter from approximately 0.067 inch to 0.031 inch results in a shoulder against which the sealing tip of the needle engaged to form a metal-to-metal seal, and thereby cut off the fluid supply. The opposite end of the shut-off needle is coaxially inserted into a 6-32 stainless steel set screw and silver soldered therein. A 6-32 nut is silver soldered to the set screw to simplify adjustment of the needle position. The shut-off needle assembly screws into a coaxial threaded hole in an actuator piston (or valve stem). The position of the shut-off needle is adjusted by varying the insertion depth of the set screw into the threaded hold in the actuator piston, and is fixed at such position by means of a lock nut. An O-ring on the actuator pisto provides a reciprocating seal between the piston and the inner walls of the shut-off assembly body, preventing the flow of process fluid into the actuator assembly.

However, such shut-off mechanism is not entirely suited for a plant environment. In the first place, minute leakage of coating chemicals past the reciprocating actuator piston seal results in crystal growth on such sealing surface, thereby accelerating wear on such seal. Further, and related thereto, due to chemical attach by the coating chemicals, the various actuator components have a tendency to fail rather quickly. In addition, the mounting connection, that is, the silver solder of the shut-off needle to the set screw, is wetted by the coating process and therefore subject to chemical attach.

Further, due to the large diameter increase from the shut-off needle or rod to the actuator piston seal, that is, from approximately a 0.040 inch diameter of the shut-off needle to the approximately 0.312 inch diameter of the actuator piston seal, the internal volume of the nozzle assembly changes substantially when the shut-off pin is opened or closed. This can result in a high velocity slug of unatomized liquid exiting the nozzle while the shut-off pin is closing.

Still further, the shut-off mechanism-to-nozzle linkage is a mechanically weak point in the system. Because of such mechanical system, adjustment of the position of the shut-off pin requires disassembly of the mechanism. In addition, setting the correct position of the shut-off pin is a trial-and-error process and must be performed at a work bench, rather than at the plant site when in use.

Lastly, the choice of materials used to construct such a system is limited in view of the fact that many of the parts are wetted by the coating chemicals. Thus, since the shut-off mechanism body is subjected to substantial mechanical loads, use of polymeric materials for corrosion resistance is not feasible.

There is also known a positive displacement piston pump disclosed in U.S. Pat. No. 4,536,140 to Guthrie for metering uniform pulses of a small amount of a coating chemical. In order to prevent piston seizure due to crystal formation resulting from minute leakage past the piston's reciprocating seals a barrier fluid is provided between the piston wall and cylinder wall. The entire disclosure of U.S. Pat. No. 4,536,140 is incorporated herein by reference. However, this patent is not directed to an ultrasonic nozzle.

Another process requirement is to direct and disperse the atomized liquid stream more accurately that was provided by the ultrasonic nozzle. Accurate direction is necessary to avoid overspray. Improved dispersion over the spray cone is necessary to avoid an extremely sharp boundary between coated and uncoated regions. This sharp boundary results in discoloration defects in coated fluorescent bulbs.

OBJECTS AND SUMMARY OF THE INVENTION

Accordingly, it is an object of the present invention to provide an ultrasonic nozzle that avoids the above mentioned difficulties.

It is another object of the present invention to provide an ultrasonic nozzle that provides automatic and immediate cessation of flow from the nozzle outlet when the nozzle is turned off.

It is still another object of the present invention to provide an ultrasonic nozzle having an internal shut-off assembly.

It is yet another object of the present invention to provide an ultrasonic nozzle which prevents corrosion of the actuator piston seal, actuator components and the mounting connection of the shut-off pin by the coating chemicals.

It is a further object of the present invention to provide an ultrasonic nozzle in which the internal volume of the nozzle assembly does not substantially change between open and closed positions, eliminating any high velocity slug formation of unatomized liquid.

It is a still further object of the present invention to provide an ultrasonic nozzle in which the position of the shut-off pin can be externally adjusted at the site with accuracy.

It is a yet further object of the present invention to provide an ultrasonic nozzle in which the shut-off mechanism is directly and securely attached to the rear surface of the ultrasonic nozzle.

It is another object of the present invention to provide an ultrasonic nozzle in which mechanical loads are predominantly carried by the shut-off assembly.

It is still another object of the present invention to provide an ultrasonic nozzle in which the choice of materials that can be used is expanded.

It is yet another object of the present invention to provide an ultrasonic nozzle having an air guide at the tip thereof for direction and dispersion of the spray formed by the atomized liquid.

It is a further object of the present invention to provide an ultrasonic nozzle having an air guide at the tip thereof so that air mixing with the atomized liquid functions as a thermal shield between the tip of the ultrasonic nozzle and the heated surface to be coated.

In accordance with an aspect of the present invention, an ultrasonic nozzle includes an atomizing surface for producing an atomized liquid; a liquid feed passageway having an inlet supplied with a process liquid at a first pressure and an outlet for supplying the process liquid to the atomizing surface, the passageway having a first section with a first diameter and a second fluidly connected section with a second, smaller diameter, with a shoulder defined between the first and second sections of the passageway; vibration means for supplying atomizing vibrations to the atomizing surface at an ultrasonic frequency; internal shut-off rod means positioned within the passageway and cooperating with the shoulder for preventing the supply of process liquid to the atomizing surface; control means for controlling the internal shut-off rod means to prevent the supply of process liquid to the atomizing surface; and barrier means positioned between the control means and the liquid feed passageway for providing a barrier fluid at a second pressure higher than the first pressure.

In accordance with another aspect of the present invention, an ultrasonic nozzle includes an atomizing surface for producing an atomized liquid; a liquid-feed passageway having an inlet supplied with a process liquid and an outlet for supplying the process liquid to the atomizing surface; vibration means for supplying atomizing vibrations to the atomizing surface at an ultrasonic frequency; and air guide means associated with the atomizing surface for direction and dispersion of a spray formed by the atomizing liquid and air at the atomizing surface.

In accordance with still another aspect of the present invention, an ultrasonic nozzle includes an atomizing surface for producing an atomized liquid; a liquid-feed passageway having an inlet supplied with a process liquid at a first pressure and an outlet for supplying the process liquid to the atomizing surface, the passageway having a first section with a first diameter and a second fluidly connected section with a second, smaller diameter, with a shoulder defined between the first and second sections of the passageway; vibration means for supplying atomizing vibrations to the atomizing surface at an ultrasonic frequency; internal shut-off rod means positioned within the passageway and cooperating with the shoulder for preventing the supply of process liquid to the atomizing surface; control means for controlling the internal shut-off rod means to prevent the supply of process liquid to the atomizing surface; barrier means positioned between the control means and the liquid-feed passageway for providing a barrier fluid at a second pressure higher than the first pressure; and air guide means associated with the atomizing surface for preventing divergence of a spray formed by the atomizing liquid and air at the atomizing surface.

The above and other objects, features and advantages of the present invention will become readily apparent from the following detailed description thereof which is to be read in connection with the accompanying drawings.

DETAILED DESCRIPTION OF THE PREFERRED EMBODIMENT

Figure 1:
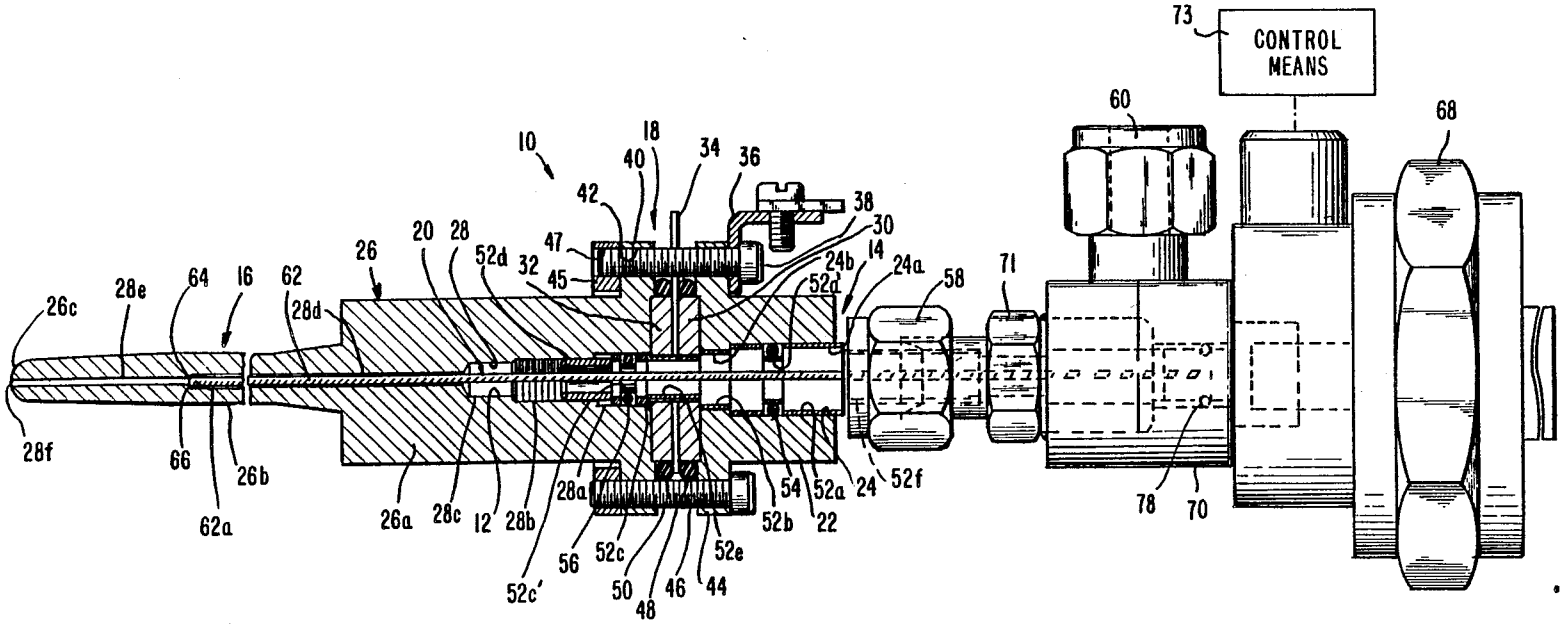
FIG. 1 (Prior Art)
FIG. 1 is a partial longitudinal cross-sectional view of an ultrasonic nozzle according to the parent of the present invention.

Referring to the drawings in detail, and initially to FIG. 1 thereof, an ultrasonic dispersion nozzle 10 disclosed in copending parent U.S. patent application Ser. No. 06/900,931, will not be described, in which dispersion nozzle 10 corresponds in many respects to that disclosed in European Patent Application No. 81101985.0. Ultrasonic dispersion nozzle 10 generally includes a liquid-free passageway 12 having an inlet and 15 supplied with a liquid and an outlet end 16 with an atomizing surface for dispersing the liquid in an atomized state, vibration means 18 for vibrating the atomizing surface at an ultrasonic frequency, and an internal shut-off assembly 20 positioned within passageway 12 for preventing supply of the liquid from the passageway 12 to the atomizing surface.

Specifically, nozzle 10 includes a reflecting horn 22 with a central bore 24 constituting the inlet and 14 of passageway 12, and an adjacent atomizing horn 26 with a central bore 28 constituting the outlet end 16 of passageway 12. Preferably, reflecting horn 22 and atomizing horn 26 are made of titanium. A pair of annular piezoelectric disks 30 and 32 are sandwiched between reflecting horn 22 and atomizing horn 26, and a contact-plane electrode 34 is, in turn, sandwiched between piezoelectric disks 30 and 32. A common body electrode 36 is connected to at least one bolt 38, a plurality of which connect reflecting horn 22, atomizing horn 26, piezoelectric disks 30 and 32, and contact-plane electrode 34 in the aforementioned arrangement.

More particularly, atomizing horn 26 includes an annular flange 40 having a plurality of apertures 42 circumferentially spaced therearound with a similar spacing as apertures 42. Bolts 38 extend through apertures 42 and 46 and are screw-threadedly received in apertures 47 in flange back-up ring 45 to provide the above-described sandwiching connections. In addition, two sealing O-rings 48 and 50 are provided in surrounding relation to piezoelectric disks 30 and 32, respectively, on opposite sides of contact-plane electrode 34 and provide a seal between the contact-plane electrode 34 and atomizing horn 26.

In general operation, an input AC electrical signal is applied between common plane electrode 34 and common body electrode 36, and because of the back-to-back orientation of piezoelectric disks 30 and 32, both disks will expand and contract simultaneously and equally at the frequency rate of the electrical signal. However, the vibration amplitude generated by disks 30 and 32 themselves is insufficient for atomization. Accordingly, reflecting horn 22 and atomizing horn 26 amplify the vibrations to a sufficient extent to cause atomization. In this regard, reflecting horn 22 and atomizing horn 26 are preferably made of titanium, which has superior acoustical properties and excellent corrosion resistance.

When the input electrical signal is bipolar, travelling pressure waves with frequencies similar to those of the input electrical signal propagate in both directions. Pressure waves, like electromagnetic waves, are characterized by a frequency f and by a propagation velocity c. The wavelength $\lambda$ is defined by c/f. When the total length from contact plane electrode 34 to one end of nozzle 10 is equal to an odd multiple of $\lambda/4$, the outgoing and incoming waves are in phase and appear to be standing still in space. A cross-sectional slice of a nozzle reveals a regularly repeating sinusoidal variation of motion, the maximum amplitude of which depends on where the slice is made. The energy in the wave is essentially trapped within the structure.

The contact-plane electrode 34 is in a nodal plane since the amplitude of motion is always zero. A point $\lambda/4$ away is in an antinodal plane, that is, a plane of maximum amplitude. At points in between, the maximum amplitude varies sinusoidally with distance. Therefore, the atomizing surface must be in an antinodal plane where the amplitude is at a maximum. In this regard, the distance between the end of reflecting horn 22 and contact plane electrode 34 is designed to have a length equal to $\lambda/4$. In like manner, the atomizing horn 26 is designed to have a length equal to an odd integral multiple of $\lambda/4$.

The atomizing horn 26 provides the amplification required for atomization by virtue of a sharp transition in diameters between a large diameter section 26*a* and a small diameter section 26*b* at a point $\lambda/2$ from the contact-plane electrode 34. The amplification or gain is equal to the ratio of the cross-sectional areas of the two sections 26*a* and 26*b*. Thus, the gain is increased either by increasing the diameter of section 26*a* or reducing the diameter of section 26*b*. Typically, gains of six to ten can be achieved, which is sufficient for atomization. Atomization takes place on an end or atomization surface 26*c* at the tip of small diameter section 26*b*.

As previously discussed, the liquid is supplied through a passageway 12 to end surface 26*c*. More particularly, a feed tube 52 extends within central bores 24 and 28, and within annular piezoelectric elements 30 and 32. Feed tube 52 has an outer diameter which varies in accordance with the variations in the diameters of central bores 24 and 28. For example, central bore 24 includes a first diameter section 24*a* and a second smaller diameter section 24*b*. Thus, feed tube 52 has a first cylindrical section 52*a* which fits within first diameter section 24*a* and a second smaller diameter section 52*b* which fits within smaller diameter section 24*b*. First cylindrical section 52*a* further includes a reduced diameter section 52*a*′ about which a sealing O-ring 54 is fit for sealing central bore 24.

Central bore 28 likewise includes different diameter sections 28*a*–28*e*, each fluidly connected to the next, and each successive section having a smaller diameter than the previous section, the last section 28*e* terminating at end surface 26*c*. In addition, section 28*b* is provided with internal screw threads. Thus, feed tube 52 has a section 52*c* which fits within section 28*a* and a screw threaded section 52*d* which screw threadedly received in section 28*b* for securing guide 52 in nozzle 10. Feed tube section 52*c* further includes a reduced diameter section 52*c* about which a sealing O-ring 56 is fit for sealing central bore 28 to prevent fluid escape. A further feed tube section 52*c* connects section 52*b* and 52*c*, and is positioned within piezoelectric disks 30 and 32. Thus, passageway 12 is sealed from the rear end of reflecting horn 22 to end surface 26*c* of atomizing horn 26.

Feed tube 52 further includes a section 52*a*, extending from the rear end of section 52*a*, with section 52*f* being coupled with a Swagelok coupling device 58. A nozzle feed opening 60 is provided for supplying liquid to section 52*f*, and then through the remainder of guide 52 and sections 28*d*–28*g* of atomizing horn 26, to end surface 26*c* thereof.

In order to achieve a sharp cessation of liquid flow from the nozzle orifice 28*f*, particularly in those applications where low surface tension liquids are used, such as the use of organotin compounds in the commercial coating of fluorescent bulbs, nozzle 10 is provided with an internal shut-off assembly 20.

Figure 2:
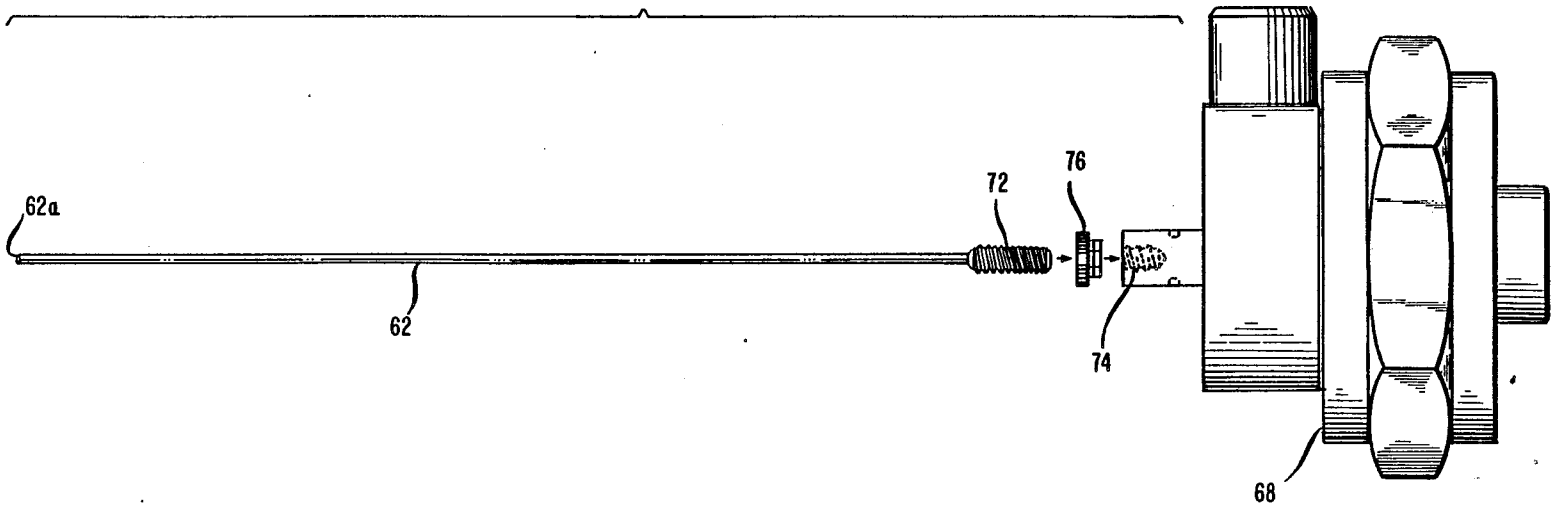
FIG. 2 is a side elevational view, in exploded form, of the internal shut-off assembly of the ultrasonic nozzle of FIG. 1.
Figure 3:
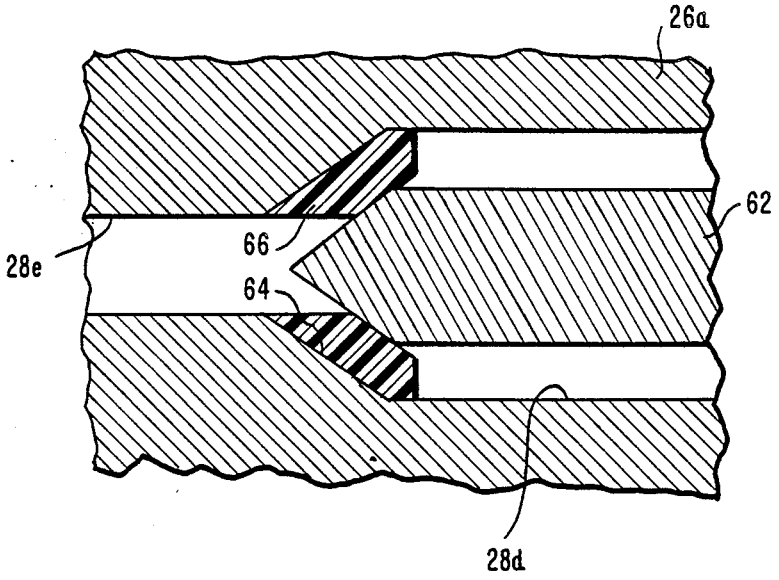
FIG. 3 is an enlarged perspective view of the sealing end of the rod of the internal shut-off assembly of FIG. 1 in assembled condition in the ultrasonic nozzle.

As shown in FIGS. 1 and 2, internal shut-off assembly 20 includes a rigid shut-off rod 62 positioned within bore 28*d* and passageway 12, extending through coupling device 58 at one end, and terminating at the opposite end thereof at the entrance to section 28*e* of bore 28. Shut-off rod 62 has an outer diameter which is smaller than the inner diameter of central bore 28*d*, as shown in FIG. 3. For example, shut-off rod 62 can have an outside diameter of 0.040 inch with a length of approximately six inches, while bore 28*d* has a diameter of 0.067 inch and bore 28*e* has a diameter of 0.031 inch. In this manner, shut-off rod 62 is spaced from feed tube 52 so as not to interfere with the waves set up by the vibrating nozzle during normal operation. Shut-off rod 62 should preferably be made of a material that is resistant to chemical attack by the liquid, and may, for example, be made of tungsten type 316 or 304 stainless steel, titanium, tantalum, Hastelloy B or C, nickel and/or Monel.

The forward tip or sealing end 62a of shut-off rod 62 may seat against a gasket made of polytetrafluoroethylene or other appropriate material.

As shown in FIGS. 1 and 3, a shoulder 64 is formed between sections 28d and 28e of bore 28, which sections have different bore diameters. Accordingly, the forward tip 62a of shut-off rod 62 cooperates with shoulder 64 at the area of bore reduction, to quickly and positively seal the nozzle so as to prevent the flow of liquid to atomizing end surface 26c in the closed position of shut-off rod 62. In order to aid in the sealing operation, forward tip 62a preferably has a substantially conical configuration, as shown in FIG. 3, and shoulder 64 likewise has a similar frusto-conical configuration. The shape of forward tip 62a, however, can be varied, such as with a hemispherical shape, as long as a sealing effect is achieved. In addition, a polymeric or the like seat 66 can be provided against shoulder 64 for ensuring a positive sealing operation, as shown in FIG. 3.

The opposite end of shut-off rod 62 is connected to a valve actuator 68, such as a Whitey "92" series NC (normally closed) valve actuator, which also forms part of internal shut-off assembly 20. In such case, a Whitey SS-92S4 valve body 70 can be used to connect Swagelok coupling device 58 to valve actuator 68. However, any other suitable electrically or pneumatically actuated valve can be used, such as angle pattern valve or the like, which can be connected to a tube or pipe fitting 71 on valve body 70. Further, the valve actuator is preferably a normally closed (NC) actuator, although a double acting (DA) actuator is acceptable. Thus, for a normally closed actuator, as is conventional, a spring is provided to normally move shut-off rod 62 to the left of FIG. 1 to a closed position. When it is desired to operate nozzle 10, air can be supplied from a control means 73 to move shut-off rod 62 to the right of FIG. 1 to an open position, whereby nozzle 10 produces an atomized spray.

More particularly, a screw 72 or the like, such as a stainless steel set screw, is fixed on the opposite end of shut-off rod 62 by silver solder or the like, and is screwed into a screw-threaded tap 74 in valve actuator 68 by means of a knurled finger nut 76, as shown in FIG. 2. In this regard, the opposite end of shut-off rod 62 extends through Swagelok coupling device 58 and valve body 70. In order to provide a sealing of such opposite end of shut-off rod 62, an O-ring seal 78 is provided, as shown in FIG. 1.

Although internal shut-off assembly 20 provides a sharp cessation of liquid flow from the nozzle orifice 28f particularly in those applications where low-surface-tension liquids are used, such as the use of organotin compounds in the commercial coating of fluorescent bulbs, various problems have arisen therewith.

Specifically, such shut-off mechanism is not entirely suited for a plant environment. This is because minute leakage of coating chemicals past the actuator piston O-ring seal 78 results in crystal growth on the dynamic sealing surfaces, thereby accelerating seal wear thereat. In addition, due to such chemical attack, the components of valve actuator 68 also tend to fail. In addition, the mounting construction for shut-off rod 62, which may be a silver solder, is wetted by the coating process and therefore subject to chemical attack.

Further, due to the large diameter increase of shut-off rod 62 (0.040 inch) to the actuator piston seal 78 (0.312 inch), the internal volume of the nozzle assembly changes substantially when shut-off rod 62 is opened or closed. This can result in a high velocity slug of unatomized liquid exiting the nozzle while shut-off rod 62 is closing.

Still further, the shut-off mechanism-to-nozzle linkage is a mechanically weak point in the sytem. Because of such mechanical system, adjustment of the position of shut-off rod 62 requires disassembly of the mechanism. In addition, setting the correct position of shut-off rod 62 is a trial-and-error process and must be performed at a work bench, rather than at the plant site when in use.

Lastly, the choice of materials used to construct such a system is limited. Many of the parts are wetted by the coating chemicals. Since the shut-off mechanism body is subjected to substantial mechanical loads, use of polymeric materials for corrosion resistance is not feasible.

The present invention overcomes the aforementioned problems by providing a lubricating/barrier-fluid cavity, thereby isolating the process fluid containing the coating chemicals from the environment. Specifically, the barrier fluid is maintained at a pressure higher than that of the process fluid, thereby preventing escape of the process fluid past the reciprocating actuator piston seal.

Figure 5:
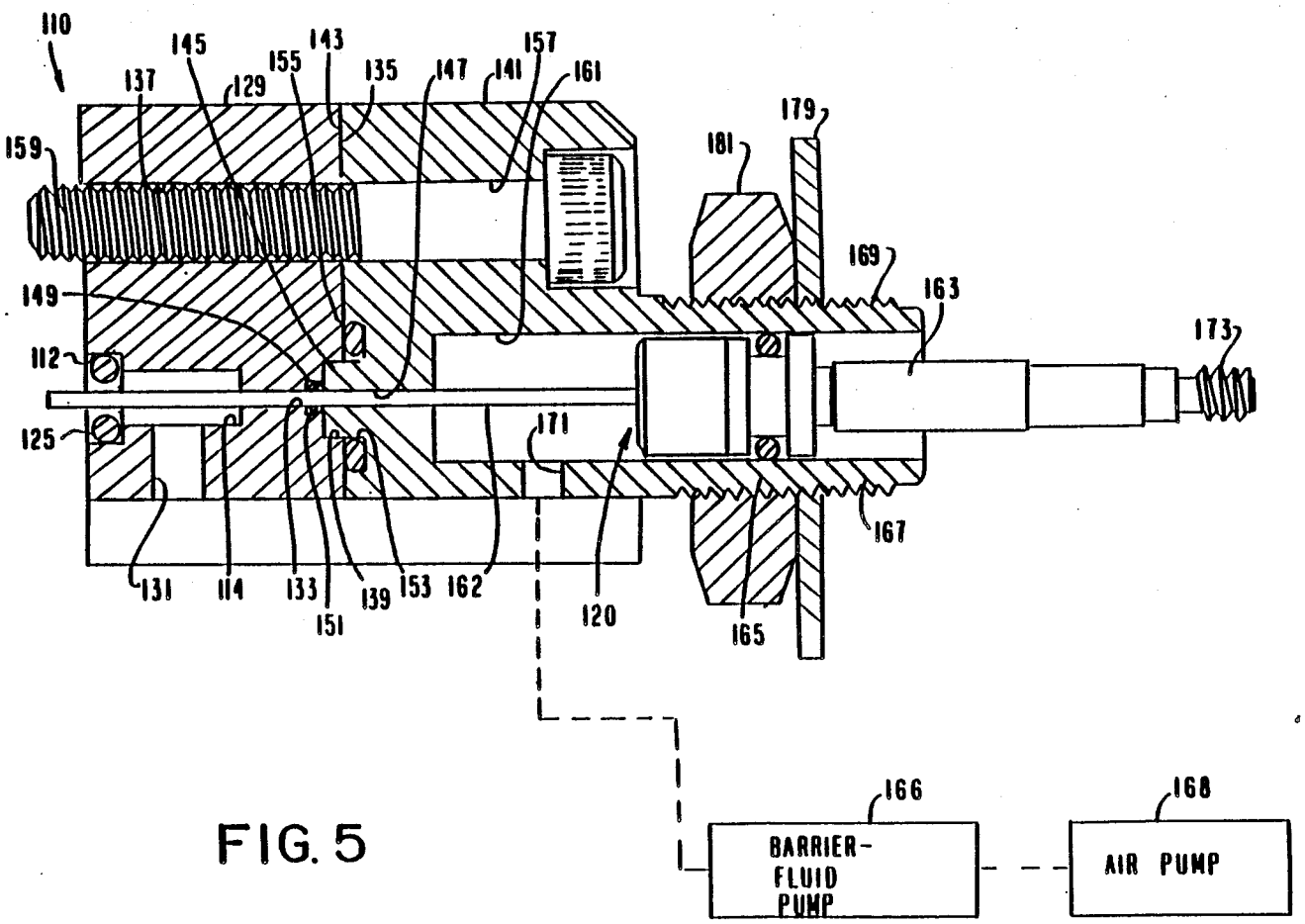
FIG. 5 is a partial longitudinal cross-sectional view of the ultrasonic nozzle of FIG. 4.
Figure 4:
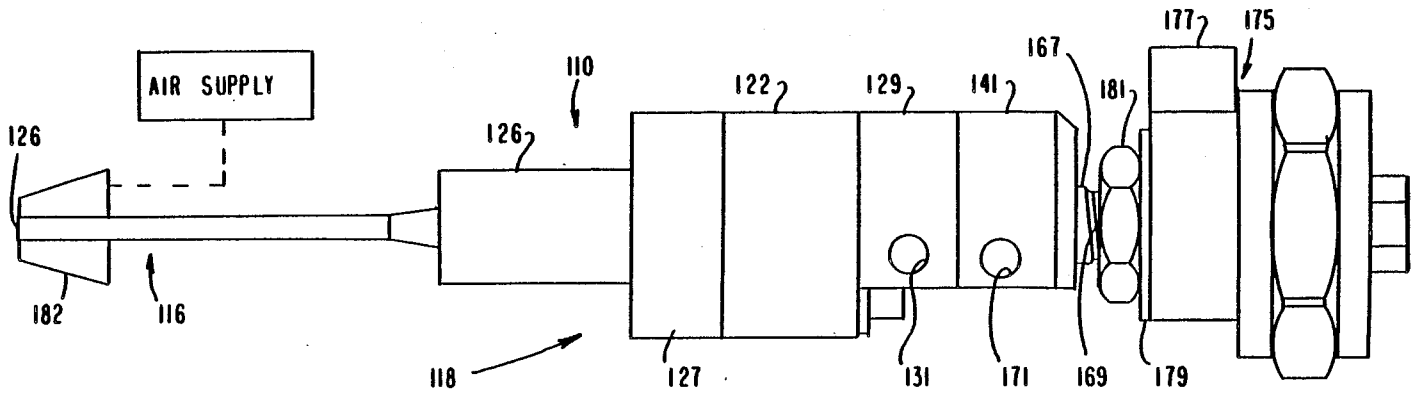
FIG. 4 is a side view of an ultrasonic nozzle according to the present invention.

Referring now to FIGS. 4 and 5, an ultrasonic dispersion nozzle 110 according to the present invention will now be described in which elements corresponding to those described above with respect to the ultrasonic dispersion nozzle 10 of FIGS. 1–3 will be identified by the same reference numerals augmented by 100. Specifically, ultrasonic dispersion nozzle 110 generally includes a liquid-feed passageway 112 having an inlet end 114 supplied with a liquid and an outlet end 116 with an atomizing surface 126c for dispersing the liquid in an atomized state, vibration means 118 for vibrating the liquid passing through passageway 112 at an ultrasonic frequency, and an internal shut-off assembly 120 positioned within passageway 112 for preventing the supply of the liquid from the passageway 112 to the atomizing surface.

Vibration means 118 of ultrasonic dispersion nozzle 110 includes a reflecting horn 122 with a central bore (not shown), and an adjacent atomizing horn 126 with a central bore (not shown). A central section 127 is sandwiched between reflecting horn 122 and atomizing horn 126 and includes a pair of annular piezoelectric disks (not shown) and a contact-plane electrode (not shown), all assembled in the same manner as the corresponding elements of ultrasonic dispersion nozzle 10 of FIGS. 1–3, and accordingly, a detailed description thereof is not believed necessary. Thus, liquid that is, coating chemicals and the like, are passed through passageway 112 extending through reflecting horn 122, central section 127 and atomizing horn 126 and is atomized at the end surface 126c of passageway 112.

As with the ultrasonic dispersion nozzle 10 of FIGS. 1–3, internal shut-off assembly 120 of ultrasonic dispersion nozzle 110 according to the present invention includes a rigid shut-off rod 162 positioned within passageway 112 and thereby extends through reflecting horn 122, central section 127 and atomizing horn 126. Shut-off rod 162 operates to stop the flow of liquid through passageway 112 in the same manner as shut-off rod 62 of ultrasonic dispersion nozzle 10, and accordingly, can be moved against a shoulder similar to shoulder 64 of ultrasonic dispersion nozzle 10.

The difference between ultrasonic dispersion nozzle 110 of the present invention and ultrasonic dispersion nozzle 10 of FIGS. 1–3 occurs at the opposite end of shut-off rod 162. Specifically, shut-off rod 162 extends rearwardly from reflecting horn 122 through a feed supply assembly 129 which is connected with reflecting horn 122. An O-ring 125 is installed in passageway 112 in feed supply assembly 129 to ensure a liquid-tight seal at the interface of passageway 112 between reflecting horn 122 and feed supply assembly 129 so as to prevent any fluid leakage. The inlet end 114 of passageway terminates in feed supply assembly 129, and a radial feed port 131 in feed supply assembly 129 extends into inlet end 114 so as to supply the coating chemicals thereto. Accordingly, the coating chemicals are supplied from radial feed port 131, to inlet end 114 of passageway 112, and then travel to the atomizing surface 126c.

In addition, feed supply assembly 129 includes a connecting bore 133 which extends rearwardly from inlet end 114 of passageway 112 to the rearward external surface 135 of feed supply assembly 129. At the position where connecting bore 133 exits feed supply assembly 129, there is a circular recess 139. Further, multiple eccentrically located bores 137 extend longitudinally through feed supply assembly 129.

A shut-off body 141 is secured to the rear surface 135 of feed supply assembly 129. Shut-off body 141 includes a front end surface 143 which abuts against rear surface 135 of feed supply assembly 129 when connected together. In this regard, a circular projection 145 is formed on front end surface 143 and its within circular recess 139 to align to feed supply assembly 129 and shut-off body 141.

Shut-off body 141 includes a connecting bore 147 which is in fluid communication with connecting bore 133 of feed supply assembly 129 when connected therewith. In this regard, end O-ring seal 149 is provided in a smaller circular recess 151 in feed supply assembly 129 and provides a seal between shut-off rod 162 and the ID of circular recess 151, thereby providing a fluid seal at the rearward terminus of the liquid feed passageway 112 in the feed supply assembly 129. This O-ring seal 149 is retained in its sealing position by the forward face of circular projection 145. In addition, shut-off body 141 includes an annular recess 153 in surrounding relation to projection 145, and another O-ring seal 155 is provided therein so as to abut against rear surface 135 of feed supply assembly 129 when feed supply assembly 129 and shut-off body 141 are connected together so as to provide a fluid seal between the connecting bore 147 and the environment. Further, multiple eccentrically located bores 157 extend longitudinally through shut-off body 141 and are in alignment with eccentrically located bores 137 in feed supply assembly 129 when feed supply assembly 129 and shut-off body 141 are connected together. Bolts 159 extend through bores 157 and 137 and are threadedly received in a threaded bore (not shown) in reflecting horn shroud 122 so as to secure shut-off body 141, feed supply assembly 129 and reflecting horn shroud 122 together.

Connecting bore 147 terminates rearwardly thereof at cynlinder bore 161. An actuator piston 163 is slidably retained within cylinder bore 161 and includes a piston seal 165 which prevents the escape of fluid past seal 165. Specifically, shut-off body 141 includes a nipple portion 167 which defines the rearward portion of cylinder bore 161. Nipple portion 167 is formed externally with screw threads 169.

In accordance with an important aspect of the present invention, a supply port 171 is formed in shut-off body 141 and is in fluid communication with cylinder bore 161, for supplying a barrier fluid a cylinder bore 161, cylinder bore 161 thereby functioning as a barrier-fluid chamber or cavity. In the situation where the coating chemical being atomized is an organotin such as monobutyltin trichloride or anhydrous in tetrachloride, the barrier fluid can be a non-detergent oil such as a libricating oil; or an organic solvent such as anhydrous methanol; or dry air. It is important that the barrier fluid be compatible with the fluid being pumped, be present in such low concentration and/or have properties such that no adverse effects are noticed at the application end of the system. Where the atomized fluid is sulfuric anhydride, the barrier fluid can be silicone or fluorocarbon liquids or dry air. In the case of aqueous solutions of radioactive, pathogenic or toxic materials, the barrier fluid can be pure water. When pumping sulfur dioxide, hydrogen sulfide, or phosgene, hydrocarbon oils or air, as well as silicone or fluorocarbon liquids can be employed. In the case of glass coating systems, the application temperature can be sufficiently high to vaporize the minor quantity of barrier fluid which leaks past O-ring seal 149 and mixes in the central feed passageway 112 with the fluid being atomized.

In basic operation, the barrier fluid is supplied to supply port 171 at a pressure which is higher than the pressure of the process fluid supplied to feed port 131. Accordingly, no process fluid containing the coating chemicals can travel to cylinder bore 161. Instead, because of the higher pressure of the barrier fluid in cylinder bore 161, some barrier fluid may escape to passageway 112. However, the amount of barrier fluid is negligible, and in any event, does not adversely affect or substantially dilute the coating chemicals therein since the barrier fluid is compatible with the process fluid. Thus, as a result of the higher barrier-fluid pressure, any net leakage past O-ring seal 149 should be into the process fluid. Further, no process fluid escapes past reciprocating seal 165. Still further, the barrier fluid will wet these respective seal surfaces, rather than the process fluid, thereby preventing crystal formation on these surfaces. Accordingly, the lubricating nature of the barrier fluid extends to all of these seal surfaces.

The barrier fluid may be supplied at the higher pressure by locating a barrier-fluid reservoir 166 at a sufficient elevation above the nozzle 110 to generate the desired gravity head or by pressuring the gas space above the barrier fluid within the reservoir 166, for example, by an air pump 168.

Referring again to FIGS. 4 and 5, the forward end of actuator piston 163 has external threads 173 thereon, which are threadedly engaged within an actuator assembly 175, which can be a Whitey 92 normally closed (NC) valve actuator, having an air port 177 by which actuator piston 163 can be controlled to moved forwardly or rearwardly in cylinder bore 161. The extent that actuator piston 163 extends into cylinder bore 161 is controlled by the insertion depth that nipple portion 167 is threadedly engaged within actuator assembly 175. In order to lock nipple portion 167 in a fixed position within the actuator assembly 175, a restraining washer 179 is provided in surrounding relation to nipple portion 167, and a shut-off adjustment lock nut 181 is provided forwardly thereof in threaded engagement with threads 169 on nipple portion 167. Thus, when nipple portion 167 is threadedly received within actuator assembly 175 to the desired depth, for example, when shut-off rod tip **62*a* engages shoulder 64, lock nut 181** is tightened, as shown in FIG. 4, such that washer 179 is in tight abutting relation to the external surface of actuator assembly 175. Of course, during the shut-off operation, the position of actuator piston 163 in cylinder bore 161 is changed by actuator assembly 175 by supplying air selectively through air port 177 in order to shut off the supply of fluid in passageway 112.

Thus, with the present invention, the monting connection of shut-off rod 162 to actuator piston 163 is wetted by barrier fluid, eliminating corrosion problems thereat. In addition, the internal volume of the nozzle assembly wetted by the process fluid does not change substantially between open and closed positions of shut-off rod 162 in view of the use of the barrier fluid in cylinder bore 161. In other words, the large diameter increase from shut-off rod 162 to the actuator piston seal 165 is located in cylinder bore 161 which contains the barrier fluid. Thus, the substantial change occurs only in the volume of cylinder bore 161 which contains the barrier fluid, and not with the process fluid.

In addition, the position of shut-off rod 162 can be adjusted externally, and the correct position of shut-off rod 162 can be determined directly, without resorting to a trial-and-error procedure, and may be performed at the site. This can be accomplished by loosening nut 181 and turning nipple portion 167 clockwise or counter-clockwise depending on the direction of the adjustment. Further, the manner in which shut-off rod 162 is secured to actuator piston 163 is simplified.

Of importance with the present invention, the process feed and shut-off portions of the assembly are separate components, and only the process feed portion, which is mechanically the simpler of the two, is wetted by the process fluid. Mechanical loads, on the other hand, are predominantly carried by the shut-off portion. This permits greater flexibility in choosing materials of construction.

Figure 6:
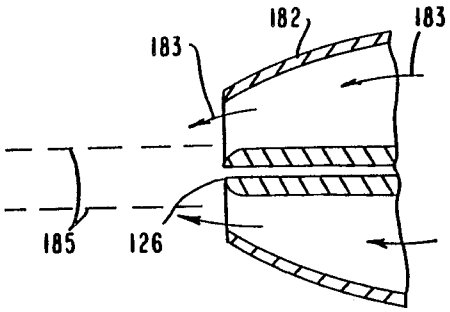
FIG. 6 is a partial longitudinal cross-sectional view of the nozzle tip of the ultrasonic nozzle of FIG. 4, with the air guide thereabout.

Referring now to FIGS. 4 and 6, a still further improvement of ultrasonic dispersion nozzle 110 will now be described. Specifically, in many instances, ultrasonic dispersion nozzle 110 is used for the coating of light bulbs. As the atomized liquid exits end surface 26c, it mixes with outside air to provide a spray thereat which is used to coat the light bulbs. However, such spray, as it leaves the end surface 26c, travels in an irregular semi-hollow conical arrangement. This has the effect of causing sharp boundaries between portions of each bulb which are to be coated with respect to portions of the bulb that are not to be coated. This sharp boundary has the effect of causing discoloration of the bulb. In addition, because the bulbs are hot during the coating process, such heat has an adverse affect on ultrasonic dispersion nozzle 110.

In order to solve this problem, ultrasonic dispersion nozzle 110 includes an air guide 182 having a substantially hollow, frusto-conical configuration in surrounding, concentric relation to the atomization surface 126c. Due to the formation and emission of atomized liquid from atomization surface 126c, converging air is pulled in and mixes with the atomized liquid to form the aforementioned spray. With the use of air guide 182, air is pulled in, as air, as indicated by arrows 183, mixes with the atomized liquid resulting in a directed, diffuse, full cone spray pattern, that is, between dotted lines 185. Because of the more diffuse outer boundary of the spray cone, substantially no discoloration of the bulb occurs and there are now sharp boundaries between coated and uncoated portions of the bulb. In addition, the air that flows through air guide 182 is positioned between the heated bulbs and atomization surface 126c of ultrasonic dispersion nozzle 110, thereby prevention damage thereto.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined in the appended claims.

What is claimed is:

1. An ultrasonic nozzle comprising:

an atomizing surface for producing an atomized liquid;

a liquid feed passageway having an inlet supplied with a process liquid at a first pressure and an outlet for supplying said process liquid to said atomizing surface, said passageway having a first section with a first diameter and a second fluidly connected section with a second, smaller diameter, with a shoulder defined between said first and second sections of said passageway;

vibration means for suplying atomizing vibrations to said atomizing surface at an ultrasonic frequency;

internal shut-off rod means positioned within said passageway and cooperating with said shoulder for preventing said supply of process liquid to said atomizing surface;

control means for controlling said internal shut-off rod means to prevent said supply of process liquid to said atomizing surface; and barrier fluid means positioned between said control means and said liquid feed passageway for providing a barrier fluid at a second pressure higher than said first pressure.

2. An ultrasonic nozzle according to claim 1; wherein said passageway has an inner surface, and said internal shut-off rod means is positioned within said passageway, said shut-off rod means having an outer surface spaced from said inner surface of said passageway and a sealing end adapted to cooperate with said shoulder to prevent said supply of liquid to said atomizing surface; and said control means includes actuator means for moving said shut-off rod means in a longitudinal direction in said passageway between a first closed position in which said supply of liquid to said atomizing surface is prevented and a second open position in which said supply of liquid to said atomizing surface is permitted.

3. An ultrasonic nozzle according to claim 2; wherein said barrier means includes a chamber positioned between said actuator means and said passageway for containing said barrier fluid at said second higher pressure.

4. An ultrasonic nozzle according to claim 3; further including supply port means for supplying said barrier fluid to said chamber, and supply means for supplying said barrier fluid to said chamber through said supply port means at said second higher pressure.

5. An ultrasonic nozzle according to claim 2; wherein said shoulder has a substantially conical configuration, and said sealing end has a substantially conical configuration with a shape that conforms substantially to that of said shoulder.

6. An ultrasonic nozzle according to claim 1; wherein said vibration means includes piezoelectric means for producing vibrations at said ultrasonic frequency, and amplifying means for amplifying said vibrations and for supplying said amplified vibrations to said atomizing surface.

7. An ultrasonic nozzle according to claim 6; wherein said amplifying means includes a reflecting horn having a central bore therein defining a portion of said passageway and an adjacent atomizing horn having a central bore therein defining another portion of said passageway, and said piezoelectric means includes at least one piezoelectric plate sandwiched between said reflecting horn and said atomizing horn.

8. An ultrasonic nozzle according to claim 7; wherein said atomizing horn includes a first section with a first outside dimension positioned adjacent said at least one piezoelectric plate, and a second section with a second, smaller diameter and an end surface of said second section forming said atomizing surface.

9. An ultrasonic nozzle comprising:

an atomizing surface for producing an atomized liquid;

a liquid feed passageway having an inlet supplied with a process liquid at a first pressure and an outlet for supplying said process liquid to said atomizing surface, said passageway having a first section with a first diameter and a second fluidly connected section with a second, small diameter, with a shoulder defined between said first and second sections of said passageway;

vibration means for supplying atomizing vibrations to said atomizing surface at an ultrasonic frequency;

internal shut-off rod means positioned within said passageway and cooperating with said shoulder for preventing said supply of process liquid to said atomizing surface;

control means for controlling said internal shut-off rod means to prevent said supply of process liquid to said atomizing surface;

barrier fluid means positioned between said control means and said liquid feed passageway for providing a barrier fluid at a second pressure than said first pressure; and air guide means associated with said atomizing surface for directing and diffusing of a spray formed by said atomizing liquid and air at said atomizing surface.

* * * * *